US007412801B2

(12) United States Patent
Papakonstantinou

(10) Patent No.: US 7,412,801 B2
(45) Date of Patent: Aug. 19, 2008

(54) SOUND ABSORBING PANEL

(76) Inventor: Panagiotis Papakonstantinou, Erimanthou 4, GR-13671 Acharnai Attikis (GR)

( * ) Notice: Subject to any disclaimer, the term of this patent is extended or adjusted under 35 U.S.C. 154(b) by 435 days.

(21) Appl. No.: 11/254,918

(22) Filed: Oct. 21, 2005

(65) Prior Publication Data

US 2007/0125010 A1 Jun. 7, 2007

(30) Foreign Application Priority Data

Oct. 21, 2004 (GR) ..... 20040100416

(51) Int. Cl.
*E04B 1/82* (2006.01)
*E04C 2/34* (2006.01)

(52) U.S. Cl. ..... 52/144; 52/145; 52/792.1; 52/794.1; 181/290

(58) Field of Classification Search ..... 52/144, 52/145, 784.12, 784.13, 792.1, 794.1, 801.11, 52/801.12; 181/290, 295; 220/615, 617, 220/682

See application file for complete search history.

(56) References Cited

U.S. PATENT DOCUMENTS 2,691,433 A * 10/1954 Farrier ..... 52/794.1
3,748,799 A * 7/1973 Tough et al. ..... 52/144
3,934,382 A 1/1976 Gartung
4,016,689 A 4/1977 Wendt
4,194,329 A 3/1980 Wendt
4,901,485 A 2/1990 Menchetti et al.
5,001,883 A * 3/1991 Landheer ..... 52/794.1
5,048,242 A * 9/1991 Cline ..... 52/126.6
6,158,176 A * 12/2000 Perdue ..... 52/144
6,584,739 B2 * 7/2003 Zeif ..... 52/263

* cited by examiner

*Primary Examiner*—Richard E. Chilcot, Jr.
*Assistant Examiner*—John M Frega

(57) ABSTRACT

A sound absorbing panel comprising a generally rectangular mat of sound absorbing material, a plastic non woven covering at the frontal mat surface facing towards the sound insulated space and a sheet metal plate covering at the rear. The sheet metal plate covering extends outwardly perimetrically around the mat and forms uniformly sized flange extensions bent inwardly by 180° to form lip portions and corresponding recessions between the flange extensions and associated lip portions. Four Z section edge members are employed, one for each of the four lateral sides of the mat, each Z section edge member comprising a base portion abutting the lateral side of the mat and two spaced apart flange portions projecting in opposite directions from the base portion, one of these flange portions entering within the abovementioned recessions of the sheet metal plate covering wherein it is being pressed to form a compact frame structure perimetrically around the sound absorbing panel.

6 Claims, 7 Drawing Sheets

SOUND ABSORBING PANEL

THE FIELD OF THE ART

The present invention relates to the field of sound insulating structures, in particular of such structures employed in industrial and commercial applications, disclosing a sound absorbing panel made in a manner such as to ensure autonomy in building of a sound insulating wall structure, since each one of the sound absorbing panels might be independently added or removed from the sound insulating wall structure.

THE BACKGROUND OF THE INVENTION

Noise control is becoming a necessity in noise polluting environments, such as in buildings of industrial, commercial, educational or recreational activities. Such usages often demand not only sound insulation of the walls surrounding the buildings, but noise controlling means close to the source of noise pollution within the building. If this is the case, the requirement arises for a supporting structure being filled with sound absorbing panels close to the source of noise pollution and surrounding the same, aiming at delimiting the source of noise pollution by providing a sound insulating barrier that may inhibit dissemination of noise in the surrounding environment.

The panels being employed in such sound insulating barrier structures are conventionally of large dimensions, typically 2.00×0.60 m rectangular panels bearing a sheet metal plate covering on either surface of the sound insulating material being encaged in between, wherein the sheet metal plate covering facing towards the noise polluting source is perforated so as to ensure noise absorption as sound waves fall upon the openings provided in the perforated sheet metal plate covering. Such panels are provided with alternatively matching side projecting protrusions and protrusion receiving recessions along their lengthier sides, so as to form a sound insulating panel assembly of adjacently matching panels that form an integral wall structure without any intermediate gaps and/or joints. The shorter sides of such rectangular panels are covered by a Π shaped sheet metal laminate offering protection of the encaged sound absorbing material, thereby resulting in an H shaped sheet metal laminate configuration of adjacent panels.

Anchorage of the aforementioned panels onto the ground requires special reinforcing structures such as heavy duty anchoring means or chemical additives, whilst building of a wall structure with the abovementioned panels and supporting structure of the same necessitates the employment of hoist equipment to lift each sound insulating panel at the top of the supporting structure and henceforth letting it slide along the supporting structure so as to effect a matching contact with neighboring panels by means of engagement of the abovementioned alternative panel protrusions and recessions.

A process of building sound absorbing walls with panels being fitted onto a supporting structure is disclosed in U.S. Pat. No. 3,934,382 (Gartung). In U.S. Pat. No. 3,748,799 (Tough et al) the sound absorbing panels are provided with a perimetrical sheet metal laminate of Π configuration and are sequentially glued one onto the other by means of double-faced adhesive tapes. In U.S. Pat. No. 4,194,329 (Wendt) the sound absorbing panels are provided with a circumferential Π sheet metal laminate and form units by encaging an assembly of panels with a Π shaped sheet metal frame extending about the outer edge of the encaged panels, thereby forming heavy structures of large dimensions, whilst in U.S. Pat. No. 4,016, 689 (Wendt) the circumferential Π sheet metal laminates in juxtaposed sound absorbing panels are joined by means of special metallic clips.

The hereinabove described sound insulating wall structures of the prior art are subject to the deficiencies of heavy on site labour employing cranes and tooling for building, connecting and anchoring the supporting structures without allowing for an independently carried out testing and certification process of the supporting structures, thereby resulting in the sound insulating wall becoming practically difficult or impossible to any change whatsoever following its building. However such a capacity to change might be required due to variation in the operation parameters of the noise polluting source in the course of time and/or to the requirement of replacement of damaged portions of the sound absorbing panels.

Furthermore if such a method of building the sound insulating wall structure is adopted, it will not allow, if the need arises, e.g. because of a relocation or expansion or differentiation of the production process in an industrial plant, safe transport of the structured sound insulating wall, since dismantling of the panels will damage many of them, whilst if sound insulation parameters vary in the novel working location, employment of the old panels might be not applicable therein. It is furthermore evident that the method of building sound insulating wall structures of the prior art results in either difficulties in ensuring access to areas of production machinery necessitating maintenance in industrial sites or in building the sound insulating surrounding walls at dimensions much larger than necessary, thereby increasing sound insulation cost and coverage of viable space by this production machinery. The cost of sound insulation structures with the abovementioned methods of the prior art is by all means elevated if one further takes into account the need of employing cranes and special tools, the special construction of the supporting structure in the same time as the assembly of the sound absorbing panels, the subsequent requirement of the simultaneous presence on site of all materials, both of those associated with building of the supporting structure and of the sound absorbing panels, as well as the compulsory employment of skilled personnel, but also of a greater number of workforce so as to adequately implement the structure and/or transport on site the bulky and heavy sound absorbing panels if the existent transporting infrastructure of elevators and/or staircases in a particular building does not offer handy transport or cannot accommodate transport of such items.

It is a principal object of the present invention to advantageously overcome the abovementioned drawbacks and deficiencies of the prior art by disclosing a sound absorbing panel that ensures an autonomy in the building of sound insulating wall structures as it may be added or removed from an already built sound insulating wall structure without any requisite preparatory process. Such independency of the sound absorbing panel of the invention from the supporting structure thereof leads to the beneficial outcome of a handy, rapid dismantling and reinstallation thereof, if a need arises due to damage or change in the operation parameters of the production equipment or relocation thereof or other, such dismantling and reinstallation process being carried out even by unskilled personnel and without employing cranes or special tools.

Another object of the present invention is to provide the proposed sound absorbing panel ready to use, industrially assembled, at dimensions substantially smaller than conventional dimensions of the prior art that will ensure handy transport thereof to mount onto a previously and independently constructed, tested and certified supporting structure, thereby ensuring in this way, in addition to the main advantage of autonomous building and addition/removal capacity, a substantial decrease in the installation cost as requirements of the prior art for machinery and tools are eliminated and requirements in the labour staff and most importantly of skilled labour are diminished.

Furthermore, the herein proposed sound absorbing panel provides for a rapid and safe dismantling thereof at any time and of re-installation at a new working location, wherein compatibility of prior and novel working locations is enhanced due to the smaller dimensions of the proposed sound absorbing panels. Finally, the herein disclosed sound absorbing panels ensure under all circumstances the cheapest solution in building sound insulating walls surrounding a specific production plant, whilst as mentioned hereinabove sound absorbing panels of the prior art are disadvantageously bulky and costly so as to ensure the necessary access to the production plant surrounded by a sound insulating wall structure.

Another problem manifested in relation to sound absorbing panels of the prior art is that with a scope of ensuring optimum sound absorption and rigidity of the panel structure, each panel, as mentioned hereinabove, is provided with a perforated metal plate covering at the side facing the noise polluting source. Such perforated metal plate covering however gives rise to reflection of a large percentage of the sound waves falling thereupon and thereby leads to difficulties in the elaboration of technical specifications for the sound insulating structure that by way of example has a rectangular configuration whereby a plurality of reflections take place that give rise to secondary noise emission sources. Furthermore, the method of building sound absorbing wall structures of the prior art results in an undesirably large vibrating surface that is as high as the overall structure and its width corresponds to the width of each one of the serially assembled panels, i.e. typically of the order of 2 m, with each panel fitted into its neighboring panels with the abovementioned alternatively formed side protrusions and corresponding recessions. Thus in the hereinabove method of building a sound absorbing wall structure of the prior art, the extensive vibrating sound absorbing structure is merely fixedly mounted onto the side pillars of the abovementioned Π shaped sheet metal edge coverings.

It is therefore an object of the present invention to advantageously overcome the hereinabove mentioned shortcomings of the prior art by providing the presently disclosed sound absorbing panel that ensures the necessary rigidity due to its substantially smaller dimensions, whilst with a scope of ensuring enhanced sound absorption properties and eliminating the reflective properties of the perforated sheet metal plate covering of the prior art and thereby rendering a reliable elaboration of technical specifications for the sound insulating structure for each particular application due to standardized sound absorbing characteristics of each one of the sound absorbing panels, each panel is provided with a sound absorbing covering of a flexible special sound absorbing type of plastic covering instead of the previously employed perforated sheet metal plate covering. Furthermore, a clearly enhanced rigidity of the panels of the invention as compared to sound absorbing panels of the prior art results due to the autonomy in the mounting of each one the herein disclosed sound absorbing panels onto the supporting structure thereof, whereby the resultant overall vibrating surface and rigidity thereof is determined by the dimensions of each one of the sound absorbing panels in themselves and is not related to the supporting structure and/or to the overall sound insulating wall structure.

SUMMARY OF THE INVENTION

The objects of the invention are accomplished by a sound absorbing panel comprising a generally rectangular mat of sound absorbing material being provided with a plastic non woven covering of the frontal surface thereof facing towards the sound insulated space, a sheet metal plate covering of the rear surface of said mat of sound absorbing material, said sheet metal plate covering extending outwardly perimetrically around said mat of sound absorbing material and forming a uniformly sized flange extension, said flange extension being bent inwardly by 180° to form a lip portion extending in a direction parallel to said sheet metal plate covering and said flange extension thereof, a recession being formed between said lip portion and said flange extension and four Z section edge members, one Z section edge member being provided for each one of the four lateral sides of the generally rectangular mat of sound absorbing material, each one of said Z section edge members comprising a base portion dimensioned to span the distance between the frontal and rear panel surfaces, abutting and securing a lateral side of the mat of sound absorbing material and two spaced apart flange portions projecting in opposite directions from the base portion and being oriented at right angles to the base portion, wherein one of said flange portions extends inwardly to overlap said plastic non woven covering of the frontal surface of the mat facing towards the sound insulated space, whereas the other one of said flange portions extends outwardly of the mat of sound absorbing material and enters within the recession being formed in between the parallel flange extension and lip portion of said sheet metal plate covering and is pressed therein to form a compact structure perimetrically around said sound absorbing panel.

BRIEF DESCRIPTION OF THE DRAWINGS

The invention will be fully disclosed to those skilled in the art by reference to the accompanying drawings, in which.

DETAILED DESCRIPTION OF PREFERRED EMBODIMENTS

Figure 1:
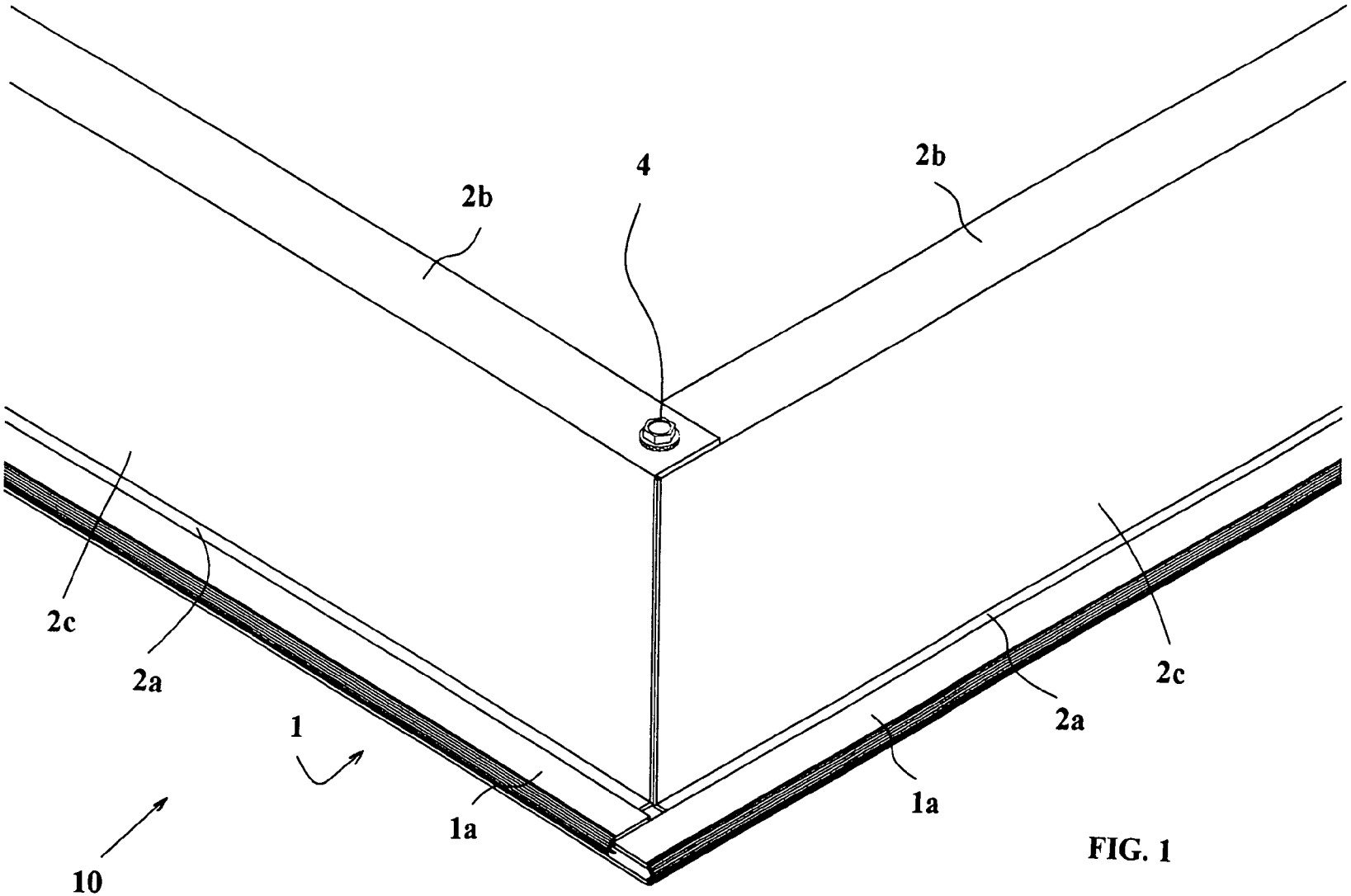
FIG. 1 shows a perspective view of a portion of the sound absorbing panel of the invention.

The sound absorbing panel of the invention shown in the accompanying drawings by general reference numeral 10 comprises a generally rectangular mat 6 of the sound absorbing material that has a thickness ranging in between 5 cm and 15 cm depending on the parameters of the noise polluting source to be insulated and the sound absorption coefficient being specified by the technical specifications of each particular application.

Similarly to sound absorbing panels of the prior art, mat 6 of the sound absorbing material of the invention is provided with a sheet metal plate covering 1 of the rear surface thereof. However, contrary to sound absorbing panels of the prior art wherein such sheet metal plate covering has length and width dimensions identical to those of the mat 6 of sound absorbing material, the sheet metal plate covering 1 of the invention being shown in FIGS. 1-3 has length and width dimensions marginally larger than those of the mat 6 of sound absorbing material, so as to form a uniform flange extension perimetrically around the mat 6, such flange extension being bent inwardly by 180° around a bending edge 1*c* (FIG. 3*a*) thereby forming a lip portion 1*a* extending parallel to the main surface 1*b* of the sheet metal plate rear covering 1. Prior to the above-mentioned bending process, the flange extension is cut off at the corners thereof so as to allow implementation of the bending process.

Figures 3, 3A, 3B, 3C:
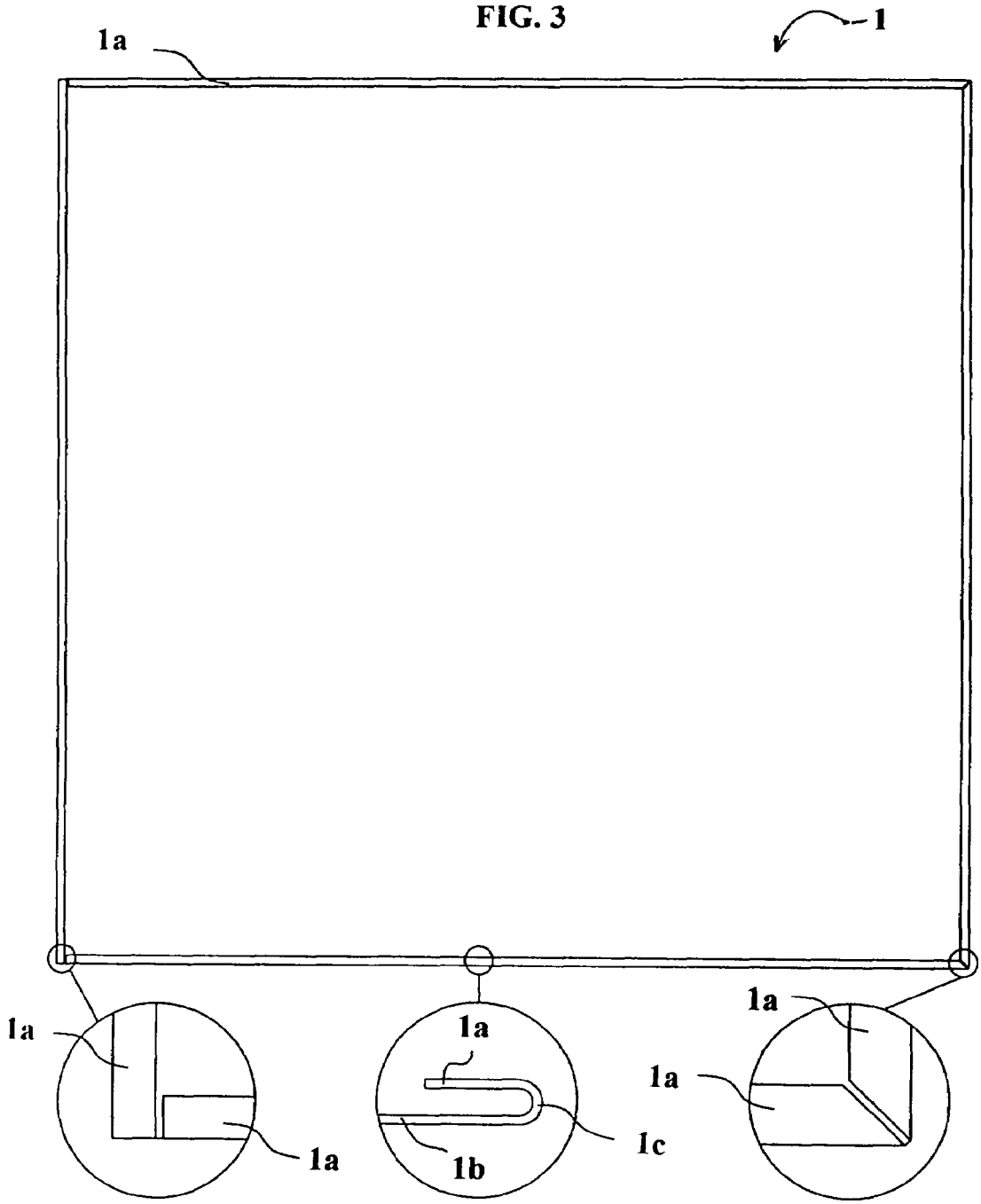
FIG. 3 shows a planar view of the sheet metal plate covering mounted at the back of the sound absorbing panel of the invention.
FIG. 3*a* shows a detailed view of the perimetrical inwardly bent flange extension of the sheet metal plate covering mounted at the rear surface of the sound absorbing panel of the invention.
FIGS. 3*b* and 3*c* show cross sectional views of alternative modes of cutting off the corners of the sheet metal plate covering of the sound absorbing panel of FIG. 3.
Figure 4:
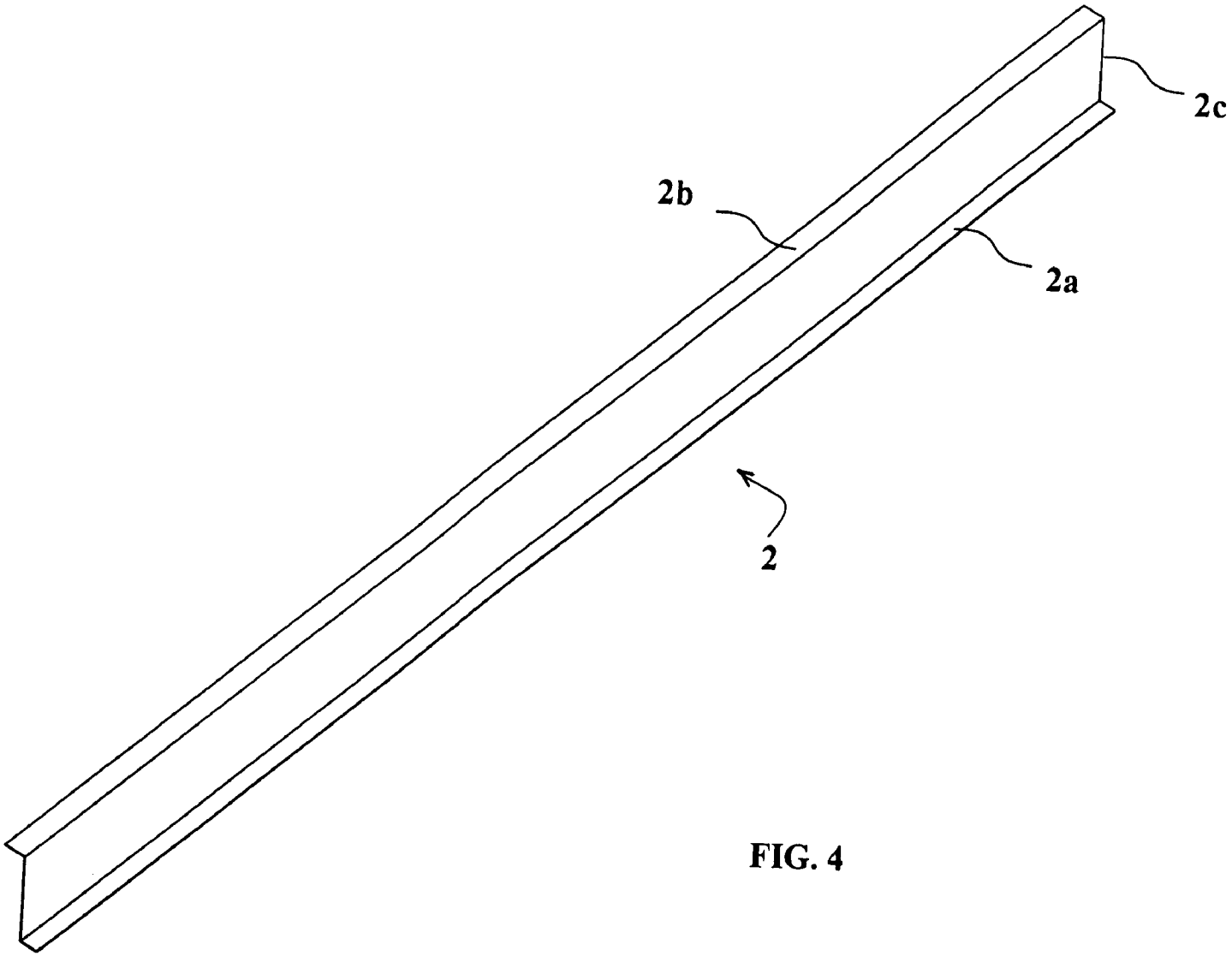
FIG. 4 shows a perspective view of a Z section edge covering of the sound absorbing panel of the invention that abuts the frontal surface thereof and is fixedly mounted within the recession being formed by the perimetrical inwardly bent flange extension of the sheet metal plate covering of the rear surface of the panel of the invention.

As illustratively shown in FIG. 3*b*, each side of the flange extension of the sheet metal plate covering 1 surrounding the sound absorbing panel is cut on either side thereof and an isosceles triangular portion is cut off so that the subsequent bending process is effected with two abutting edges of the sheet metal plate covering 1 cut at an angle of 45°.

Alternatively, as shown on FIG. 3*c*, a rectangular portion might be cut off from two sides only of the flange extension or from one edge only of each one of the sides, so that the edge of each bent lip portion 1*a* will extend parallel to the adjacent flange extension.

As mentioned hereinabove, sound absorbing panels of the prior art comprise a metallic Π section perimetrically or partially surrounding and securing the mat 6 of sound absorbing material, whilst in the present invention a Z section edge member 2 is provided for each one of the four lateral sides of the mat 6. Each Z section edge member 2 comprises a base portion 2*c* dimensioned to span the distance between the frontal and rear panel surfaces, abutting and securing a lateral side of the mat 6 of sound absorbing material, and two spaced apart flange portions 2*a*, 2*b* projecting in opposite directions from the base portion 2*c* and being oriented at right angles to the base portion 2*c*, wherein flange portion 2*b* extends inwardly to overlap the frontal surface of the mat 6 facing towards the sound insulated space, whereas flange portion 2*a* extends outwardly of the mat 6 of sound absorbing material and enters within the recession being formed in between the parallel flange extension 1*b* and lip portion 1*a* of the sheet metal plate covering 1 of the sound absorbing panel 10. Following insertion of flange portions 2*a* of all four Z section edge members 2 within the corresponding recessions of the sheet metal plate covering perimetrically around the sound absorbing panel 10, the three abutting laminates 1*a*, 2*a* and 1*b* are pressed together thereby forming a compact structure.

As shown in FIG. 1, in accordance with a preferred embodiment of the invention, bolts 4 are employed to fixedly mount together abutting flange portions 2*b* of Z section edge members 2.

As mentioned hereinabove, the substantially rigid structure of the sound absorbing panel 10 of the invention and the herein proposed relatively smaller dimensions thereof allow for the employment of a flexible covering 5 of the frontal surface of the panel facing towards the noise emission source.

In accordance with a preferred embodiment of the invention, the frontal surface covering 5 of the sound absorbing panel 10 is a surface of synthetic, non woven, thermosetting polyethylene-polypropylene material of sufficient mechanical strength, with chemical properties such as to demonstrate resistance to all alkaline and acids and biologically resistant to bacteria and fungi, etc. The possibility of employment of such a surface covering in accordance with the invention as the sole frontal surface covering of the sound absorbing panel 10 of the invention is a very much preferred solution since it may eliminate the undesirable reflective effects of perforated metal plate coverings of sound absorbing panels of the prior art. It is however possible to add an additional surface covering on top of the abovementioned frontal surface covering 5 of synthetic, non woven thermosetting polyethylene-polypropylene material to comply with aesthetic requirements of particular applications.

Figure 2:
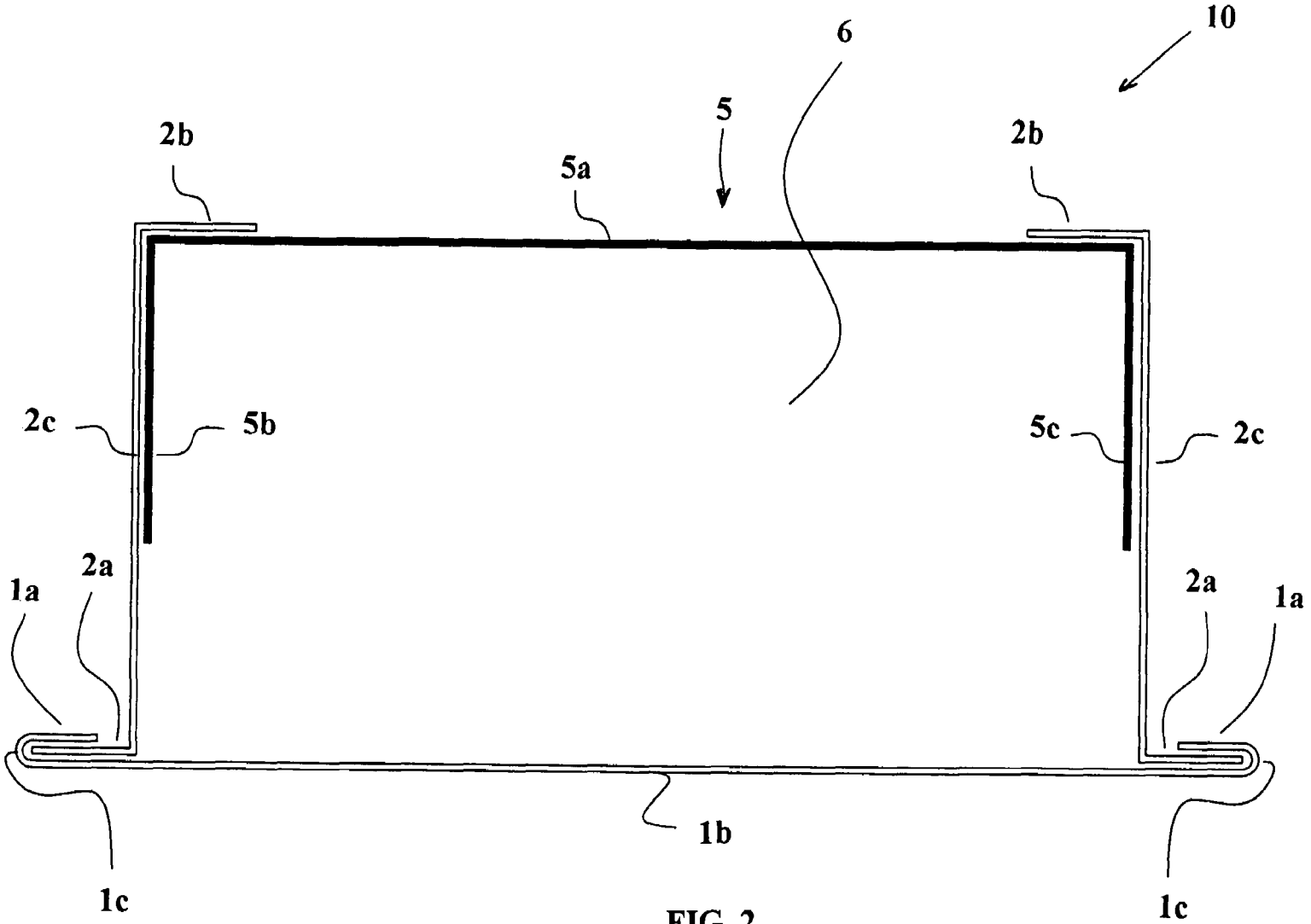
FIG. 2 shows a cross sectional view of the sound absorbing panel of FIG. 1.

As shown in FIG. 2, the frontal surface covering 5 of the sound absorbing panel comprises a main surface 5*a* disposed parallel to the main surface 1*b* of the sheet metal plate covering 1 of the rear surface of the sound absorbing panel, said main surface 5*a* covering the frontal surface of the mat 6 of sound absorbing material. According to preferred embodiment of the invention main surface 5*a* further extends into side extensions 5*b*, 5*c* that abut onto the lateral sides of the mat 6 of sound absorbing material. Eventually, the base portions 2*b* of Z section edge members 2 abutting side extensions 5*b*, 5*c* of the frontal surface covering 5, as well as the flange portions 2*b* thereof perimetrically abutting main surface 5*a* are fixedly glued thereupon.

Figure 5:
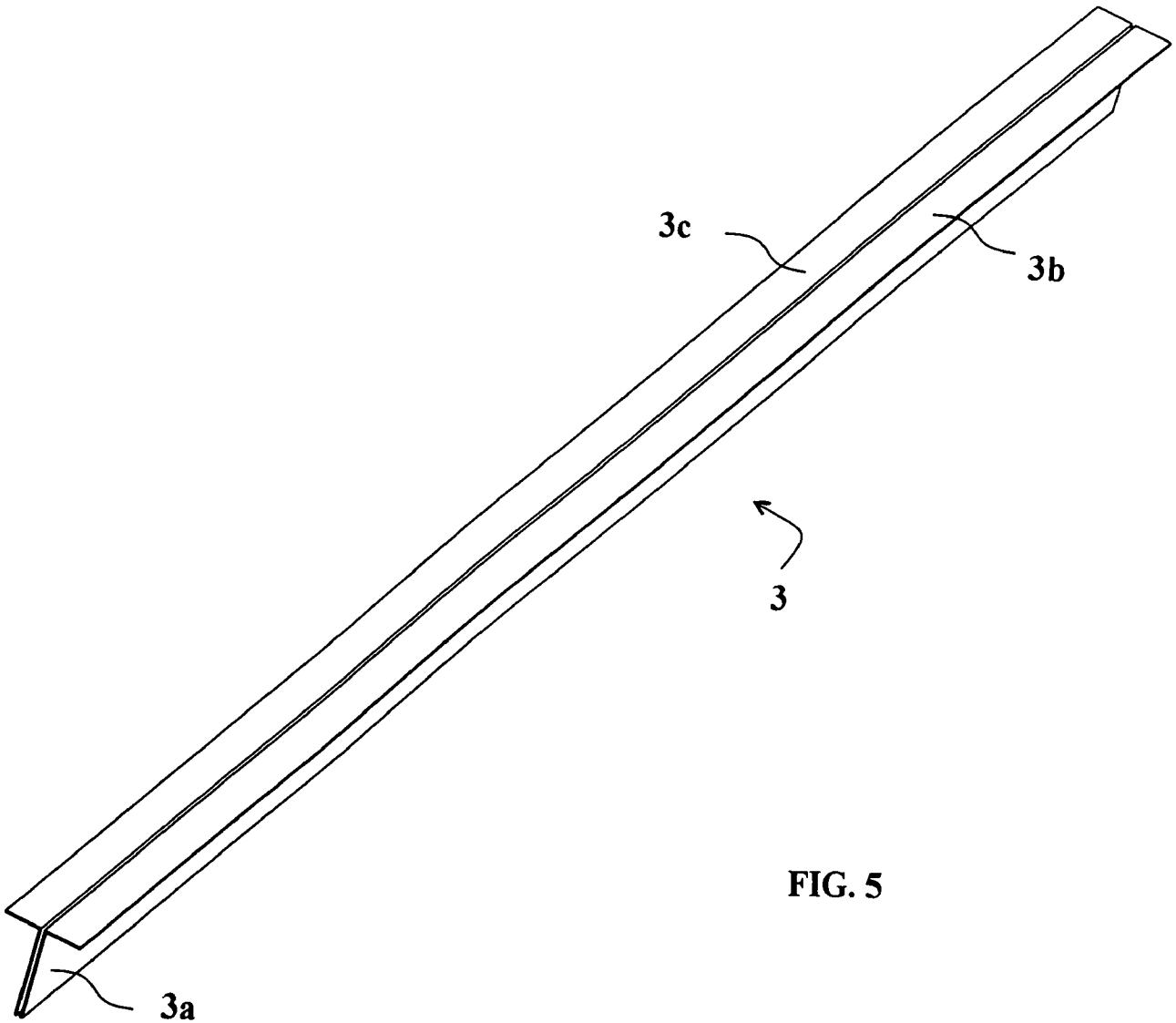
FIG. 5 shows a perspective view of a T section metal laminate adapted to intermediately reinforce sound absorbing panels of larger dimensions.
Figure 5A:
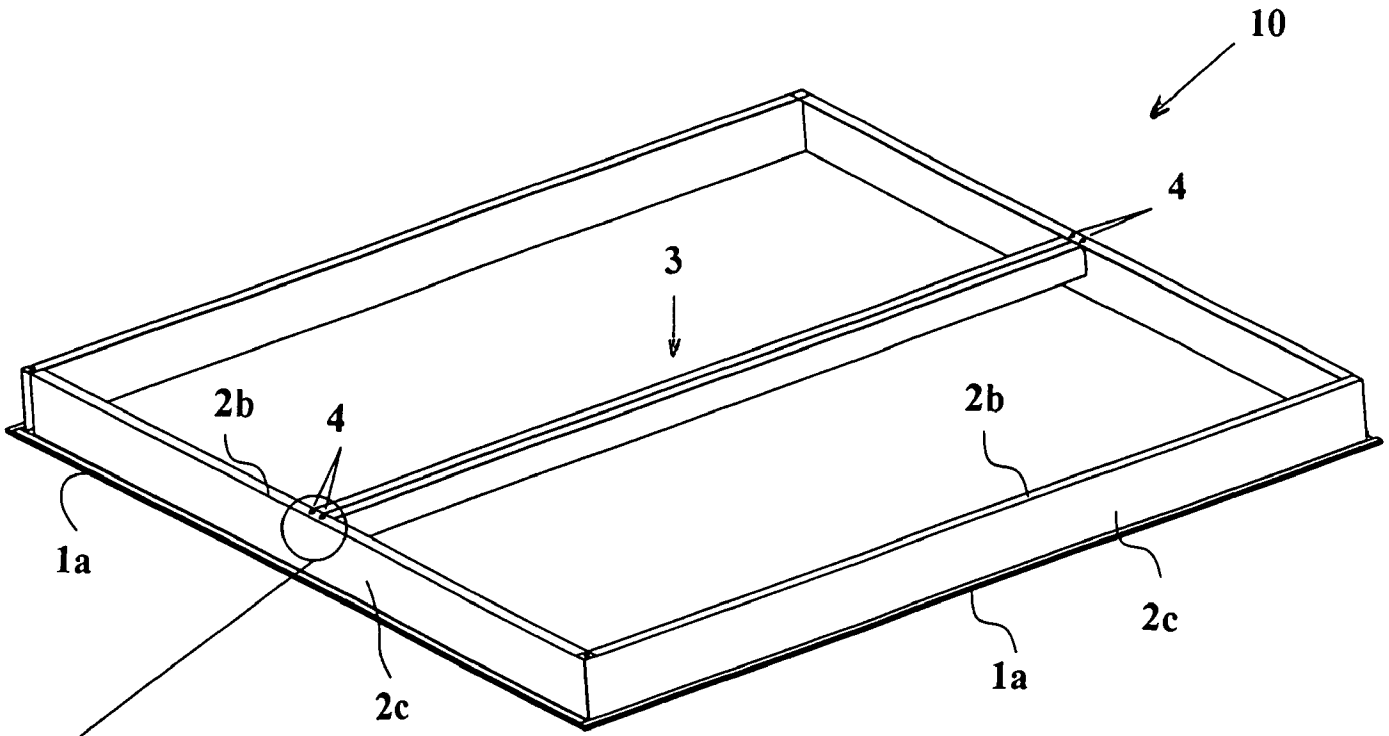
FIG. 5*a* shows a perspective view of the sound absorbing panel of the invention being provided with the T section metal laminate of FIG. 5.
Figure 5B:
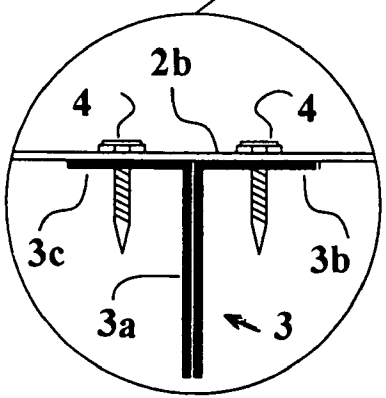
FIG. 5*b* shows a detail of mounting of the T section metal laminate onto the sound absorbing panel.

If the case arises for sound absorbing panels of relatively larger dimensions, it is possible to employ a T section metal laminate member 3 as perspectively shown in FIG. 3 and as shown in FIGS. 5*a*, 5*b* embodied in a sound absorbing panel to provide intermediate reinforcing thereof. Such a T section metal laminate member 3 comprises a core 3*a* of a length corresponding to the length of the base portion 2*c* of the surrounding Z section edge member 2 and two equally sized legs 3*b*, 3*c* extending on either side of core 3*a* at a length preferably equivalent to the length of flange portion 2*b* of the surrounding Z section edge member 2. In case where such an intermediate reinforcing T section metal laminate member 3 is employed, two independent mats 6 of sound absorbing material are disposed on either side of the core 3*a* thereof and two independent frontal surface coverings 5 are employed correspondingly glued onto the abutting sides 3*a*, 3*b* and 3*a*, 3*c* of the T section member 3.

Figure 6:
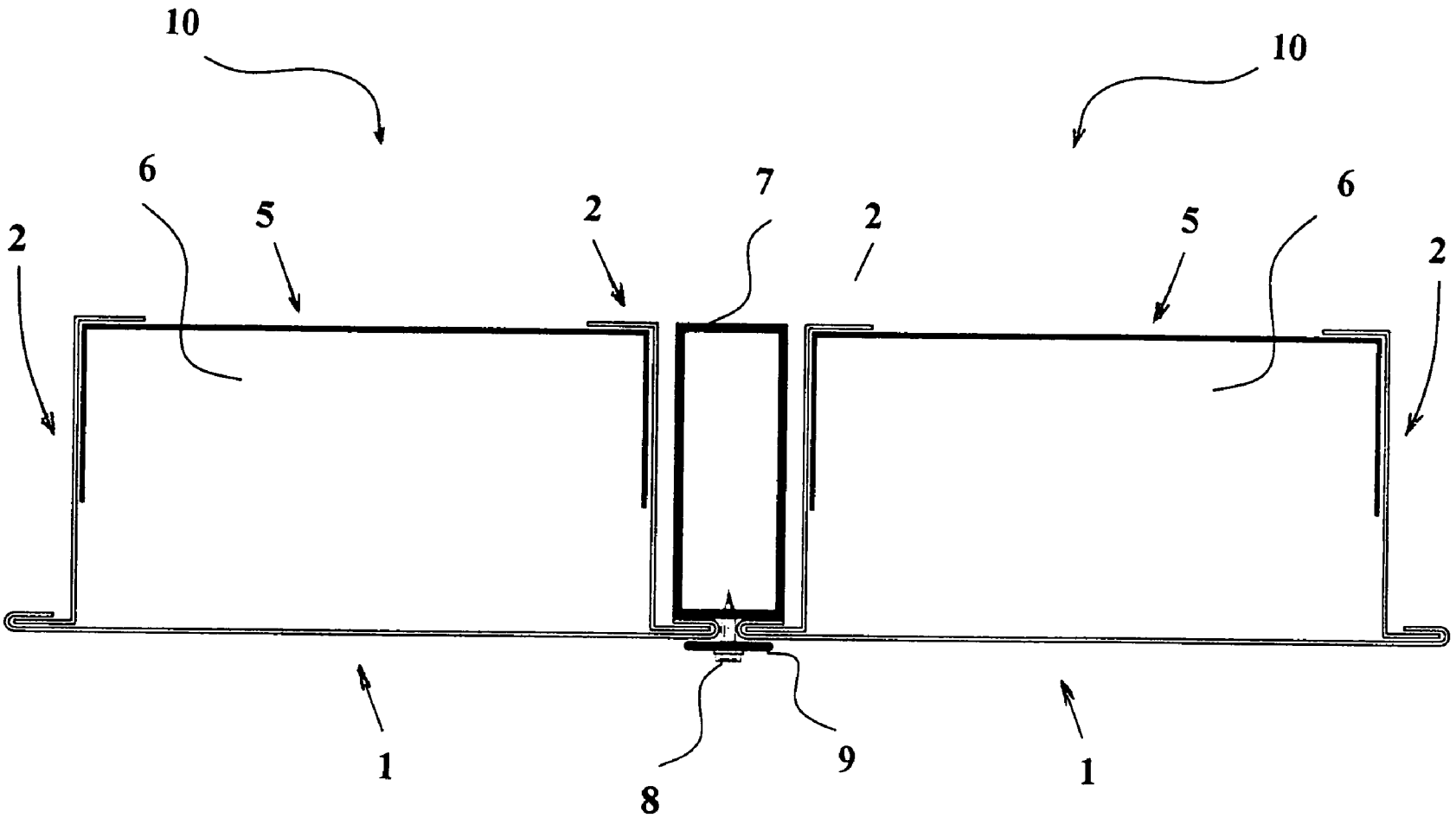
FIG. 6 shows a cross sectional view of a pair of adjacent sound absorbing panels of the invention being assembled on either side of an intermediate pillar of the supporting structure thereof.

FIG. 6 shows an illustrative arrangement of a pair of two adjacent sound absorbing panels 10 on either side of a metallic supporting structure comprising pillars 7 extending vertically in between serially adjacent sound absorbing panels 10. Hereinabove described flange extensions and lip portions of the sheet metal plate covering 1 embodying flange portions 2*a* of the Z section edge members 2 extend along the frontal surface of pillar 7 and are screwed therein employing connecting bolts 8 and interposed washers 9. Two or more bolts 8 are used on each side of each one of the sound absorbing panels 10 so as to render a sound absorbing wall structure of sufficient rigidity. It is obvious that the herein proposed assembling process of the sound absorption panels allows for a rapid and safe dismantling of whichever panel might be required and it further allows for the employment of sound absorbing panels of varying thicknesses mounted onto the same supporting structure if such thickness variations are required, e.g. close to the noise polluting source.

The sound absorbing panels of the invention may be offered in varying dimensions, illustratively ranging in between 150×150 mm and 1195×1200 mm, in any geometrical two dimensional configuration whatsoever.

The invention claimed is:

1. Sound absorbing panel comprising a generally rectangular mat of sound absorbing material being provided with a plastic non woven covering of the frontal surface thereof facing towards the sound insulated space, a sheet metal plate covering of the rear surface of said mat of sound absorbing material, said sheet metal plate covering extending outwardly perimetrically around said mat of sound absorbing material and forming a uniformly sized flange extension, said flange extension being bent inwardly by 180° to form a lip portion extending in a direction parallel to said sheet metal plate covering and said flange extension thereof, a recession being formed between said lip portion and said flange extension and four Z section edge members, one Z section edge member being provided for each one of the four lateral sides of the generally rectangular mat of sound absorbing material, each one of said Z section edge members comprising a base portion dimensioned to span the distance between the frontal and rear panel surfaces, abutting and securing a lateral side of the mat of sound absorbing material and two spaced apart flange portions projecting in opposite directions from the base portion and being oriented at right angles to the base portion, wherein one of said flange portions extends inwardly to overlap said plastic non woven covering of the frontal surface of the mat facing towards the sound insulated space, whereas the other one of said flange portions extends outwardly of the mat of sound absorbing material and enters within the recession being formed in between the parallel flange extension and lip portion of said sheet metal plate covering and is pressed therein to form a compact structure perimetrically around said sound absorbing panel.

2. Sound absorbing panel according to the above claim 1, wherein said sheet metal plate covering is cut off at the corners thereof to enable bending perimetrically around said mat of sound absorbing material.

3. Sound absorbing panel according to the above claim 1, wherein bolts are employed to fixedly mount together abutting flange portions of said Z section edge members that extend inwardly to overlap said plastic non woven covering of the frontal surface of said mat of sound absorbing material.

4. Sound absorbing panel according to the above claim 1, wherein said plastic non woven covering of the frontal surface of said mat of sound absorbing material comprises a main surface covering the frontal surface of the mat of sound absorbing material, said main surface being disposed parallel to said sheet metal plate covering of the rear surface of the mat of sound absorbing material, and side extensions that abut onto the lateral sides of said mat of sound absorbing material, wherein said main surface is fixedly glued onto said flange portions of Z section edge members overlapping said plastic non woven covering of the frontal surface of the mat and said side extensions of said plastic non woven covering of the frontal surface of the mat of sound absorbing material is fixedly glued onto said base portions of Z section edge members abutting thereupon.

5. Sound absorbing panel according to the above claim 1, wherein said plastic non woven covering of the frontal surface of said mat of sound absorbing material is a surface of synthetic, non woven, thermosetting polyethylene-polypropylene material of sufficient mechanical strength.

6. Sound absorbing panel according to the above claim 1, further comprising a T section metal laminate member embodied within a sound absorbing panel to provide intermediate reinforcing thereof, said T section metal laminate member comprising a core of a length corresponding to the length of the base portion of said Z section edge members and two equally sized legs extending on either side of said core at a length equivalent to the length of the flange portions of said Z section edge members overlapping said plastic non woven covering of the frontal surface of the mat of sound absorbing material, wherein two independent mats of sound absorbing material are disposed on either side of said core of the T section metal laminate member and two independent pieces of said plastic non woven covering of the frontal surface of said mat of sound absorbing material are employed, each one of said plastic non woven coverings for each one of said two independent mats of sound absorbing material, said plastic non woven coverings being correspondingly glued onto the core and legs of said T section metal laminate member abutting thereupon.

* * * * *